US005522742A

United States Patent [19]

Futaki et al.

[11] Patent Number: 5,522,742

[45] Date of Patent: Jun. 4, 1996

[54] CLEAN-OUT ARRANGEMENT FOR JET PROPELLED WATERCRAFT

[75] Inventors: Yoshiki Futaki; Noboru Kobayashi, both of Iwata, Japan

[73] Assignee: Yamaha Hatsudoki Kabushiki Kaisha, Iwata, Japan

[21] Appl. No.: 415,477

[22] Filed: Mar. 31, 1995

[30] Foreign Application Priority Data

| | | | |
|---|---|---|---|
| Apr. 1, 1994 | [JP] | Japan | 6-065067 |
| Apr. 11, 1994 | [JP] | Japan | 6-071916 |
| Aug. 5, 1994 | [JP] | Japan | 6-184902 |

[51] Int. Cl.[6] ..... B63H 11/01

[52] U.S. Cl. ..... 440/46

[58] Field of Search ..... 440/38, 46; 60/220, 60/221; 114/270

[56] References Cited

U.S. PATENT DOCUMENTS

| | | | |
|---|---|---|---|
| 4,664,054 | 5/1987 | Nishida | 114/270 |
| 5,123,867 | 6/1992 | Broinowski | 440/38 |
| 5,224,887 | 7/1993 | Futaki | 440/46 |

FOREIGN PATENT DOCUMENTS

| | | | |
|---|---|---|---|
| 65490 | 3/1991 | Japan | 440/46 |

*Primary Examiner*—Stephen Avila
*Attorney, Agent, or Firm*—Knobbe, Martens, Olson & Bear

[57] ABSTRACT

A number of embodiments of jet propelled watercraft wherein the jet propulsion unit is positioned in a recess on the under side of the hull. A part of the water inlet opening of the jet propulsion unit is removable from above so as to permit clean-out of the jet propulsion unit water inlet and impeller when still mounted in the hull. Various locations and access openings are disclosed. In addition, embodiments of safety arrangements for disabling the prime mover when the removable part is removed for servicing are described.

25 Claims, 14 Drawing Sheets

CLEAN-OUT ARRANGEMENT FOR JET PROPELLED WATERCRAFT

BACKGROUND OF THE INVENTION

This invention relates to jet propelled watercraft and more particularly to an improved arrangement for permitting the clean-out of foreign articles from the flow path through the jet propulsion unit.

The use of so-called water jet propulsion units for propelling watercraft is becoming widely accepted. These jet propulsion units have a number of advantages over more conventional propeller-driven watercraft. One of these advantages is that the jet propulsion unit permits operation in relatively shallow bodies of water. Another advantage is that the jet propulsion unit can be built into a tunnel or recess formed on the underside of the hull. This gives the watercraft a neat appearance because none of the propulsion system is exposed to view. However, these advantages provide certain disadvantages.

In the first instance, because the jet propulsion unit is capable of operating in very shallow water, it is prone to the injection of foreign articles. This can cause the articles to become entangled with the impeller shaft or clog other parts of the jet pump. Furthermore, when the jet propulsion unit is mounted in the underside of the hull, the water inlet opening is not easily accessed for clean-out purposes.

It is, therefore, a principal object of this invention to provide an improved clean-out arrangement for the jet propulsion unit of a watercraft.

It is another object of this invention to provide an improved clean-out arrangement for a jet propelled watercraft which permits accessing to the jet propulsion unit while the watercraft is still floating in the body of water.

It is yet a further object of this invention to provide an improved clean-out arrangement for a jet propelled watercraft wherein the jet propulsion unit may be cleaned from above and while the watercraft is still floating in a body of water.

SUMMARY OF THE INVENTION

This invention is adapted to be embodied in a clean-out arrangement for the jet propulsion unit of a watercraft. The watercraft has a hull defining a recess in an under surface thereof and the jet propulsion unit is mounted at least in part in the recess. The jet propulsion unit comprises a water inlet portion defining a downwardly facing inlet opening through which water may be drawn from a body of water in which the hull is operated. An impeller portion journals an impeller for receiving and drawing water through the water inlet portion. A discharge nozzle portion is also provided through which water pumped by the impeller is discharged for propelling the hull through the body of water. At least a part of one of the portions is removable from above for cleaning foreign objects from the water path through the jet propulsion unit.

DETAILED DESCRIPTION OF THE PREFERRED EMBODIMENTS OF THE INVENTION

Figure 1:
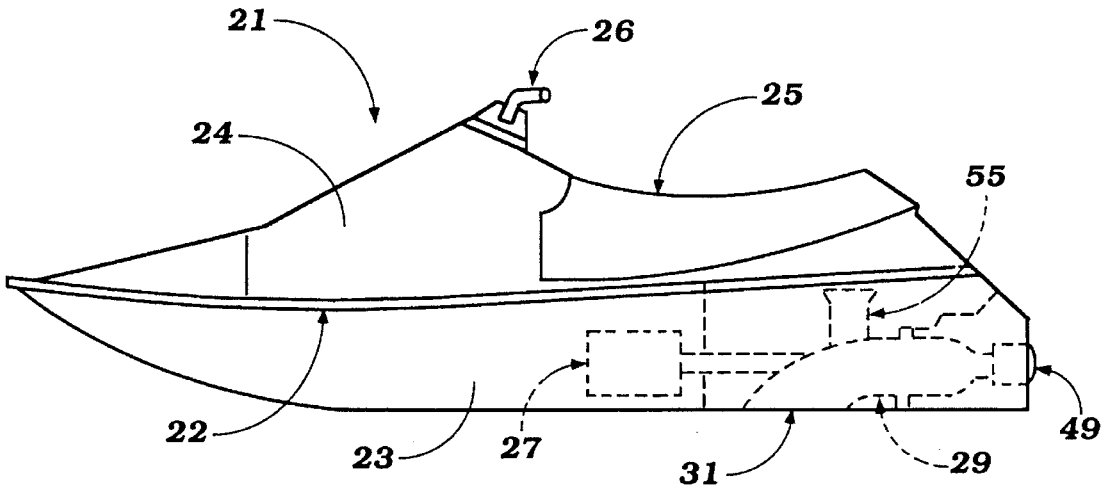
FIG. 1 is a side elevational view of a jet propelled watercraft constructed in accordance with a first embodiment of the invention.
Figure 2:
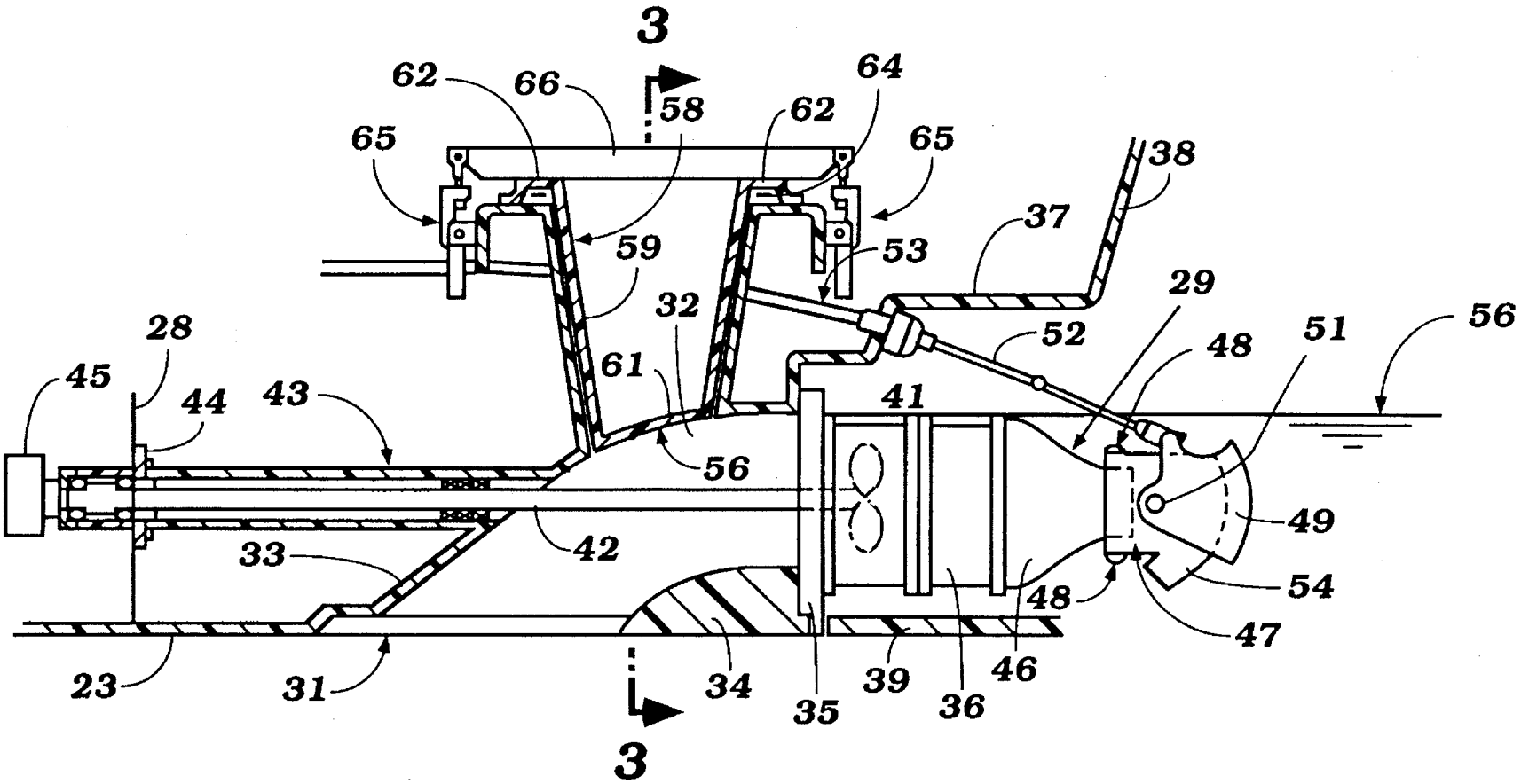
FIG. 2 is an enlarged longitudinal cross-sectional view taken through the jet propulsion unit of the watercraft illustrated in FIG. 1 and shows the clean-out arrangement in its normal operating condition.
Figure 3:
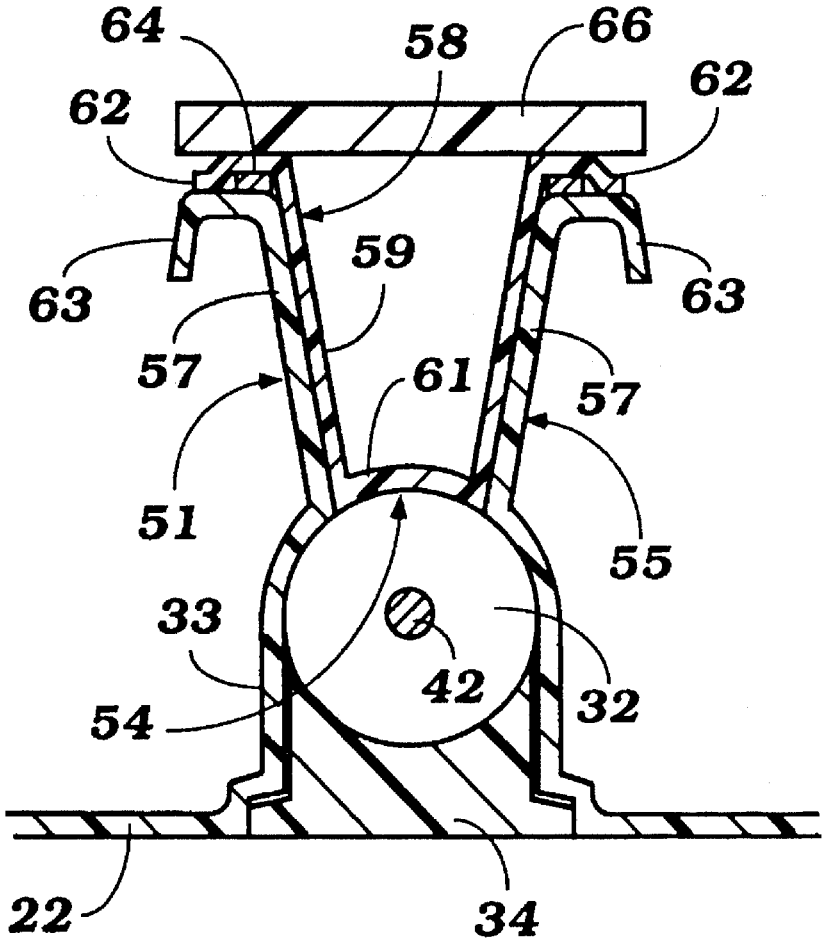
FIG. 3 is a cross-sectional view taken along the line 3—3 of FIG. 2.

Referring now in detail to the drawings and initially to the embodiment of FIGS. 1–3, a small, personal watercraft constructed in accordance with this embodiment of the invention is identified generally by the reference numeral 21. This particular embodiment of the invention is described in conjunction with a so-called personal-type watercraft. It will be readily apparent to those skilled in the art, however, how the invention can be applied to a wide variety of types of watercraft and some of the embodiments described herein will relate to certain other types of watercraft in which the invention can be employed. The invention does have particular utility, however, in connection with personal watercraft because these watercraft are frequently powered by water jet propulsion units. The invention has particular utility in connection with watercraft having these types of propulsion units.

The watercraft 21 is comprised of a hull, indicated generally by the reference numeral 22 which consists of a lower hull portion 23 and an upper deck portion 24. The hull portions 23 and 24 are formed from a suitable material such as a molded, fiberglass-reinforced, resinous plastic or the like. It will, of course, be readily apparent to those skilled in the art how the invention can be employed in conjunction with watercraft having other materials from which the hull is formed.

As a personal-type watercraft, the deck portion 24 is provided with a longitudinally extending straddle-type passenger seat 25 which extends along the rear portion of the watercraft 21. A rider/operator can sit on the seat 25 in saddle fashion with his feet placed in the foot areas (not shown) formed on opposite sides of the seat 25. The seat 25 may have sufficient length so as to accommodate additional passengers seated in tandem fashion behind the operator.

A control mast and handlebar assembly 26 is provided by the deck portion 24 forwardly of the seat 25 for control of the watercraft 21. The handlebar assembly 26 may include a steering function for steering of the watercraft 21, in a manner which will be described. In addition, throttle controls and reverse thrust bucket controls, at least some of which will also be described generally, may be carried by the handlebar assembly 26 for control of the watercraft 21.

The hull and deck portions 23 and 24 provide an engine compartment which extends at least in part beneath the forward part of the seat 25. An internal combustion engine, shown schematically and indicated by the reference numeral 27, is provided in this engine compartment for providing a propulsive force for the watercraft 21. As will be readily apparent to those skilled in the art, any known type of propulsion unit or prime mover may be provided for this purpose.

The underside of the hull portion 23 toward the rear end thereof is provided with a recess or tunnel which is defined at its forward end by a bulkhead 28. This tunnel contains a jet propulsion unit, indicated generally by the reference numeral 29, which is driven, in a manner to be described, by the prime mover 27 for providing a propulsive force for the watercraft 21.

The jet propulsion unit 29 is comprised of a water inlet portion that has a downwardly facing water inlet opening 31 which actually opens through an opening in the lower part of the hull portion 23. This water inlet opening 31 permits water to be drawn into a water inlet portion 32. The water inlet portion 32 is formed, in the illustrated embodiment, in part by a section 33 of the lower hull portion 23.

The rear portion of the opening 31 is described by a further hull piece 34 that is fixed in any suitable manner to the hull portion 33 and which provides a support for a flange 35 of an impeller housing portion 36. The impeller housing portion 36 is a separate element of the jet propulsion unit 29 and is positioned beneath a horizontally extending wall 37 of the hull portion 23 which defines the rear end of the aforenoted tunnel and which terminates at transom 38. This portion of the tunnel is underlied by an underplate 39 which may be affixed in a suitable manner to the remainder of the hull portion 23.

An impeller 41 is journaled in the impeller housing portion 36 in a suitable manner and is fixed to the rear end of an impeller shaft 42. The impeller shaft 42 extends forwardly through a pilot tube 43 which may be formed as a separate member or an integral part of the hull portion 33. The forward part of this pilot portion 43 is mounted by a flange 44 at the rear end of the bulkhead 28. The impeller shaft 42 extends forwardly through the bulkhead 28 to a coupling 45 which is connected in driving relationship with the output shaft of the engine 27 in any well known manner.

The water that has been pumped by the impeller 41 is discharged rearwardly through the impeller housing portion 36 through a plurality of straightening vanes (not shown) to a discharge nozzle portion 46. A steering nozzle, indicated generally by the reference numeral 47, is pivotally mounted on the end of the discharge nozzle portion 46 by means of a pair of vertically disposed pivot pins 48. This steering nozzle is coupled, by means of a bowden wire actuator or the like (not shown) to the control mast 26 for steering of the steering nozzle 47 and, accordingly, the watercraft 21 in a manner well known in this art.

A reverse thrust bucket 49 may be pivotally mounted on the steering nozzle 47 by means of horizontally extending pivot pins 51. The reverse thrust bucket 49 is coupled by means of a bowden wire 52 contained within a protective sheath 53 to a control which is positioned in proximity to the mast 26 or carried by it for shifting between a forward drive position and a reverse drive position, the latter of which is shown in FIG. 2. In this reverse position, the water discharged by the discharge nozzle 46 is redirected through a duct 54 of the steering nozzle 47 in a forward direction so as to generate a reverse thrust on the watercraft.

The construction of the watercraft 21 and its jet propulsion unit 29 as thus far described may be considered to be conventional. It should be apparent that this construction provides a very neat appearing watercraft since the jet propulsion unit 29 is substantially completely contained within the tunnel in the hull portion 23. However, and as has already been noted, because this type of watercraft can be operated in very shallow water, there is a likelihood that foreign objects could be drawn through the inlet opening 31 and inlet portion 32 to become entangled with the impeller shaft 42.

In accordance with the invention, a clean-out mechanism, indicated generally by the reference numeral 55, is provided so that foreign objects can be removed even when the watercraft 21 is in a body of water, as indicated by the line 56 in FIG. 2. This line shows the condition when the watercraft 21 is stationary in the body of water or moving only at a low rate of speed therein.

This clean-out mechanism includes a clean-out opening 56 that is formed in an upper portion of the water inlet passage 32 and which is defined by a funnel-shaped surrounding wall 57 of the hull part 33. If the water inlet portion 32 is formed by an integral part of an outer housing assembly of the jet propulsion unit 29, this funnel-shaped wall 57 can be formed in such part.

A closure member, indicated generally by the reference numeral 58, is provided which has a sidewall 59 that is complimentary to the inner surface of the wall 57 and a lower portion 61 which is complimentary to the shape of the opening 36 and thus forms a smooth, continuous flow path through the water inlet 32 to the impeller 41.

The closure member 58 is provided with an outwardly extending flange 62 that overlies a corresponding flange 63 formed by the clean-out portion 56 and specifically by the upper ends of the walls 57. A groove is formed in one or both of these members and a sealing gasket 64 is clamped therebetween so as to provide a watertight seal when in the operating mode. A pair of toggle-like clamps, indicated generally by the reference numeral 65, are carried by the hull flange portion 63 and cooperate with a locking bar 66 which holds the closure member 58 in position.

Figure 4:
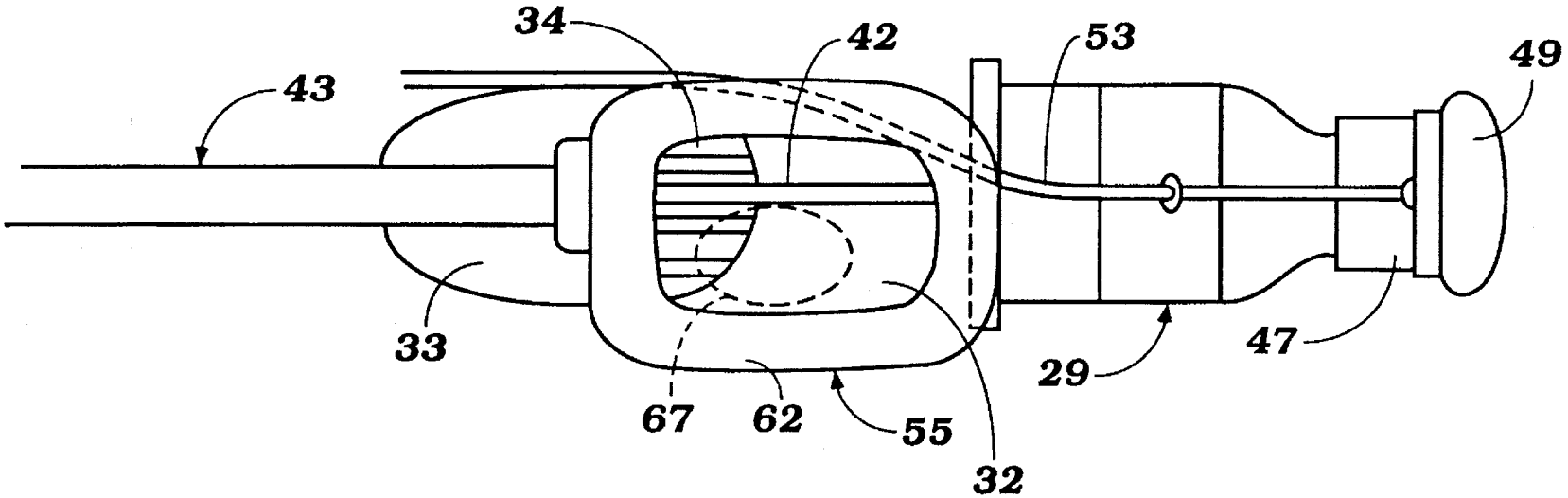
FIG. 4 is a top plan view looking at the jet propulsion unit with the closure panel removed for cleaning operation.

To effect clean-out, the toggle clamps 65 are released, the bar 66 removed, and the closure plug 58 removed so that an operator can place his hand into the opening 56 and remove foreign objects therefrom. As may be seen in conjunction with FIG. 4, the opening 54 is offset to one side of the impeller shaft 66 so that the operator's arm, indicated at 67 in this figure, can easily pass below the impeller shaft 42 and clean the entire inlet portion 32 from above.

Figure 5:
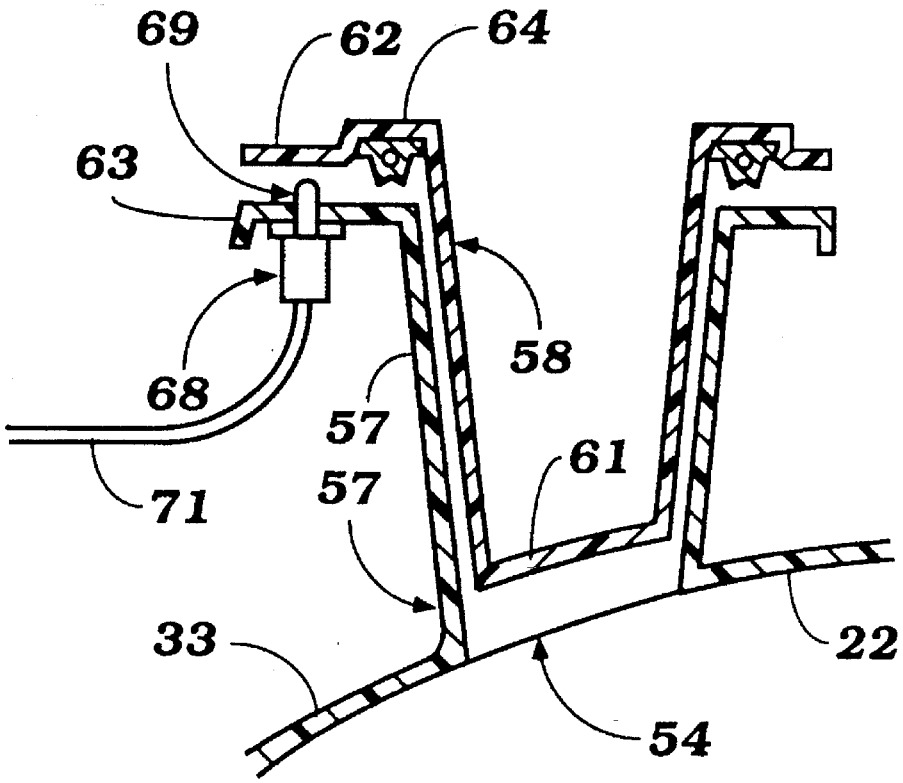
FIG. 5 is a partial cross-sectional view, perpendicular to FIG. 2, and shows a first type of safety cutoff switch that can be employed in conjunction with the invention.

To provide safety during the clean-out operation, a switch 68 (FIG. 5) may be mounted on the hull flange 63. The switch 68 has a plunger portion 69 which is engaged by the flange 62 of the closure member 58 when it is in position so as to open an electrical circuit to the kill switch or kill circuit of the watercraft and permit normal operation. However, when the closure member 58 is removed for cleaning purposes, as shown in FIG. 5, the plunger 69 will be urged upwardly and the circuit, including the conductor 71, will be enabled to activate the kill switch and preclude operation of the engine 27. Thus, when the clean-out device 55 is opened, it will not be possible to operate the engine 27.

Figure 6:
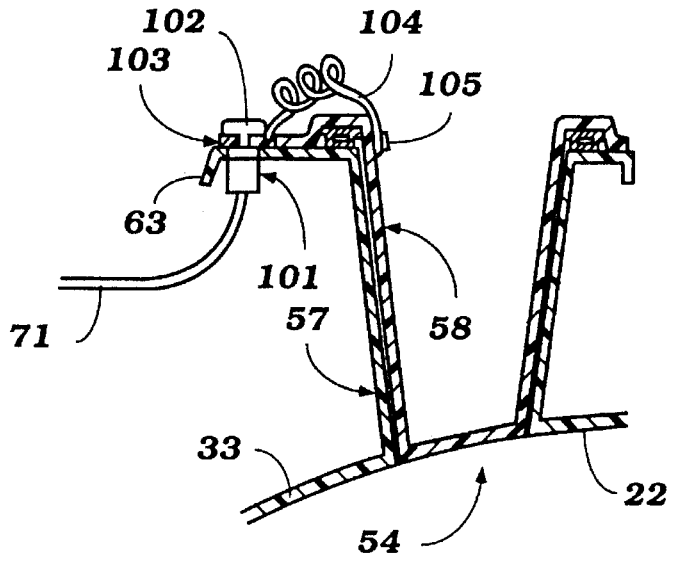
FIG. 6 is a cross-sectional view, in part similar to FIG. 5, and shows another type of safety cutoff switch when in the operating condition.
Figure 7:
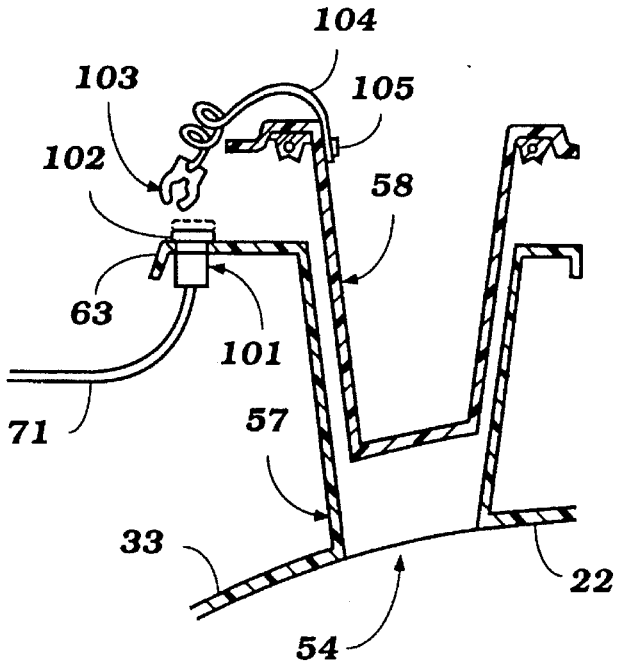
FIG. 7 is a cross-sectional view of the embodiment shown in FIG. 6 and shows the cutoff switch operative to shut off the operation of the prime mover in preparation for a cleaning operation.
Figure 8:
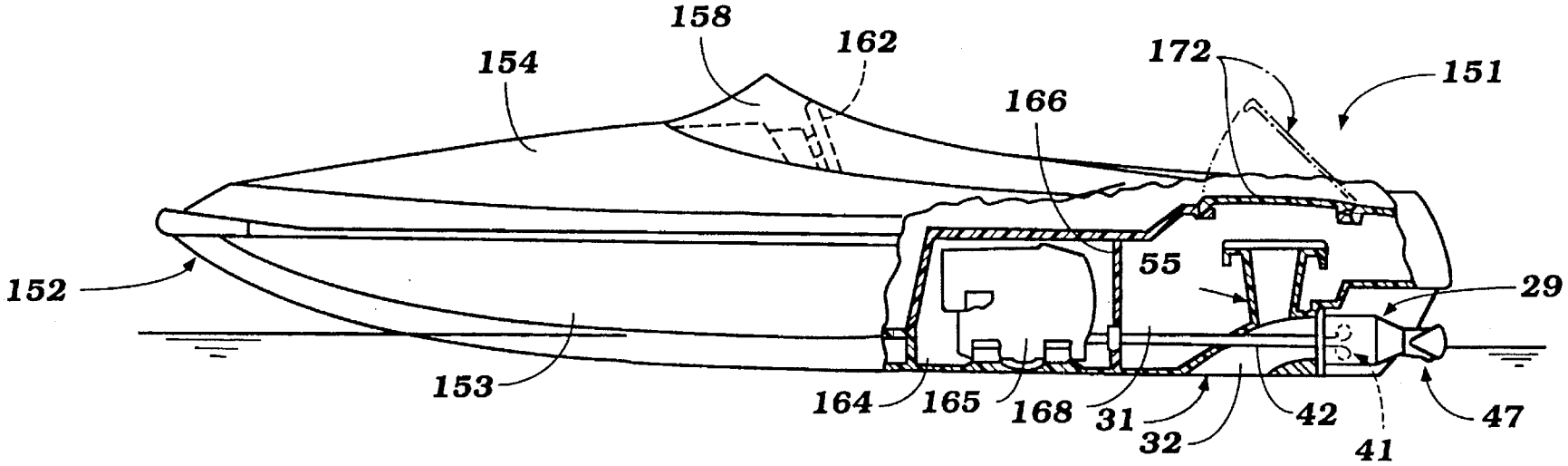
FIG. 8 is a side elevational view of a watercraft, in part similar to FIG. 1, but shows a different embodiment of the invention, with a portion broken away and shown in cross-section to illustrate the cleaning arrangement.
Figure 9:
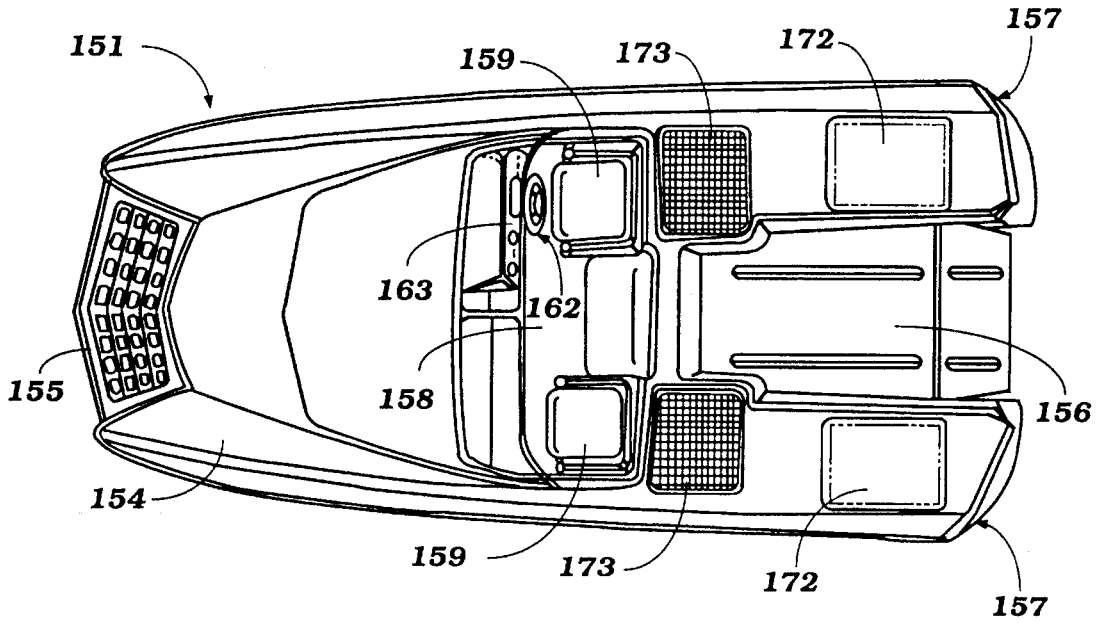
FIG. 9 is a top plan view, on a reduced scale, of this embodiment.
Figure 10:
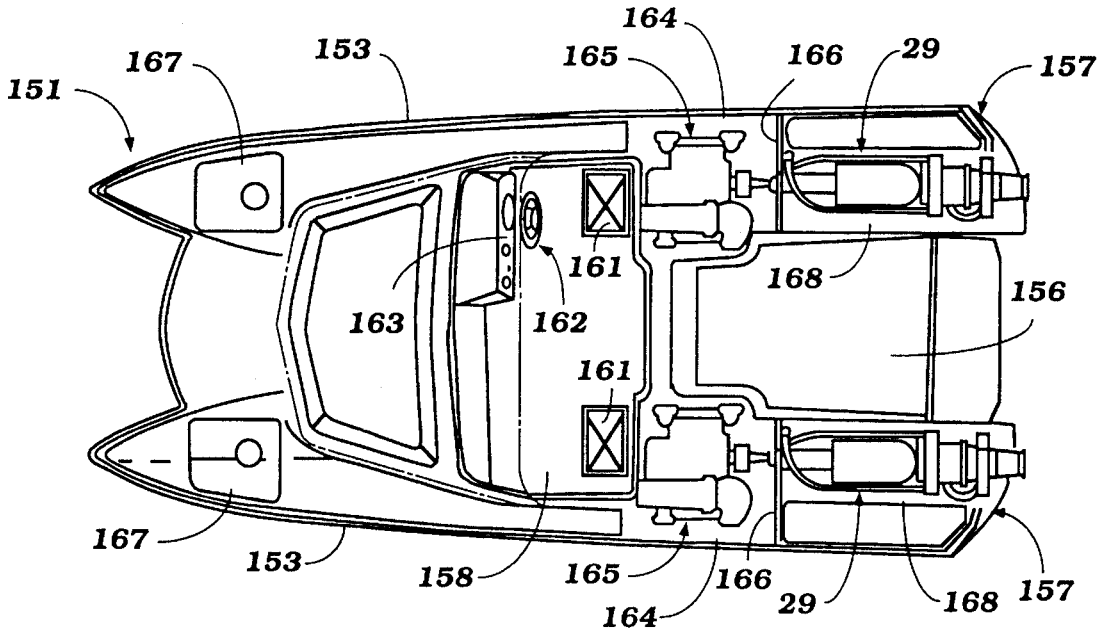
FIG. 10 is a cross-sectional view taken along a horizontal plane and shows the internal components of this embodiment.
Figure 11:
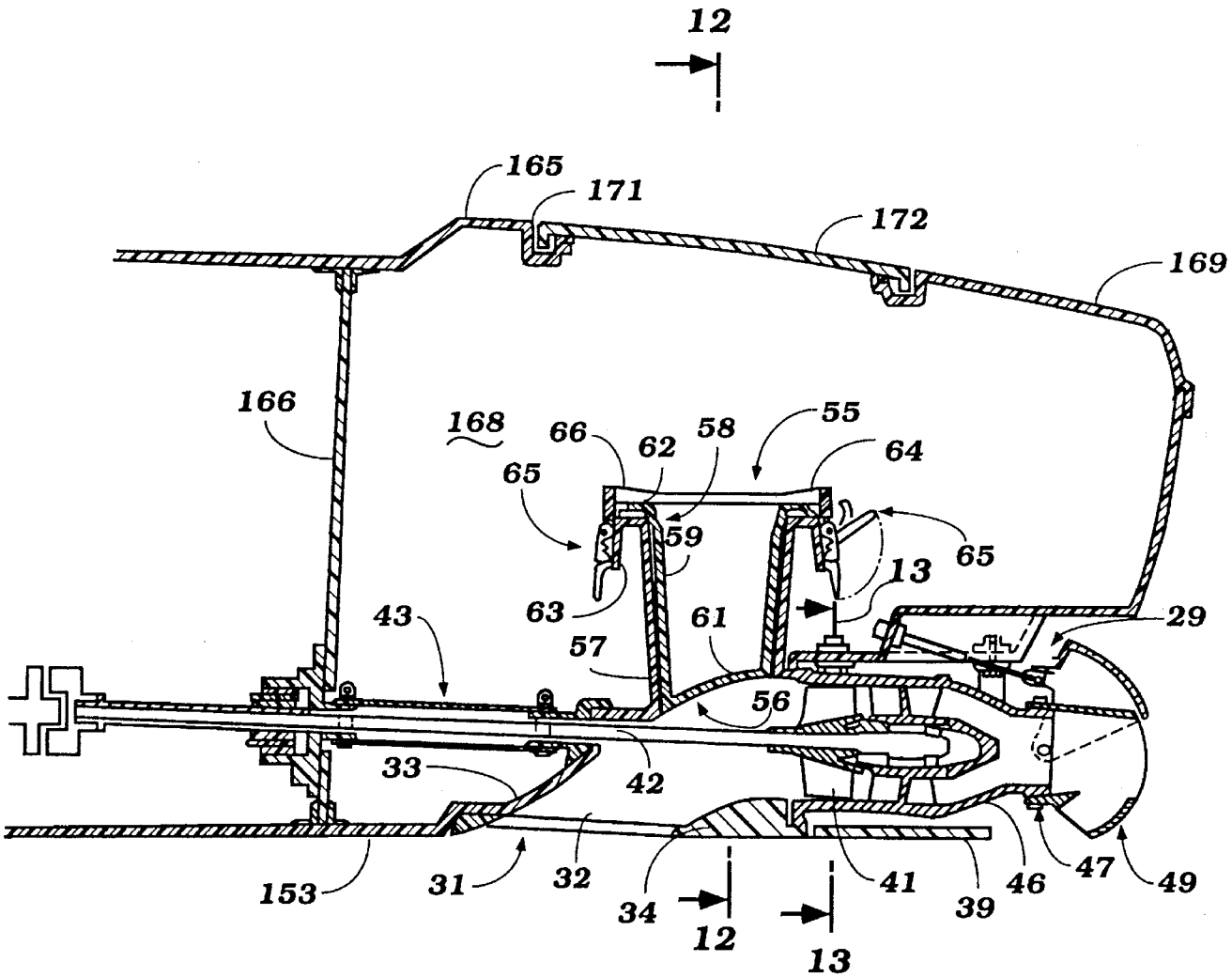
FIG. 11 is an enlarged cross-sectional view taken through one of the jet propulsion units and showing the cleaning arrangement.

FIGS. 6 and 7 show another safety arrangement which utilizes the type of switch, indicated generally by the reference numeral 101, which is utilized in conjunction with arrangements for killing the engine when an operator falls overboard. The switch 101 has a plunger 102 beneath which a locking tab 103 is normally positioned so as to hold the switch in the position shown in FIG. 6 when the closure member 58 is in its closed position. The locking tab 103 is connected to a wire 104 which is, in turn, connected to the closure member 58 by a fastener 105. Hence, when the closure member 58 is removed (FIG. 7), the switch element 102 will be biased to its closed position and activate the kill circuit for the engine to stop it.

In these embodiments, the closure member 58 and its latching mechanism is disposed beneath the seat 25. Therefore, the seat 25 must be removed or a portion of it removed so as to permit the clean-out operation. With the small, personal-type watercraft as illustrated in these embodiments, this is a more practical way to permit the clean-out operation and at the same time maintain a compact construction.

In the embodiments of FIGS. 1–7, the clean-out device 55 has been positioned beneath the seat of the watercraft 21. The reason for this is because the clean-out device 55 should be located in proximity to the water inlet portion 32 of the jet propulsion unit 29. With different configurations of watercraft, the jet propulsion unit water inlet portion 32 will be disposed beneath other portions of the watercraft and suitable clean-out openings can be appropriately located in such other portions. Also and as has been noted, the invention is not limited to utilization with watercraft of the configuration shown in the embodiments of FIGS. 1–7.

FIGS. 8–13 show another watercraft configuration wherein the invention may be employed. In these figures, a watercraft, indicated generally by the reference numeral 151 is provided which has a hull 152 formed from an under hull portion 153 and a deck portion 154. Like the previously described embodiment, the hull 152 may be formed from any suitable material such as a molded, fiberglass-reinforced resin or the like. Basically the watercraft 151, in this embodiment, is a type of patrol or rescue boat having a configuration as generally described in U.S. Pat. No. 5,366,028, issued Nov. 22, 1994, and entitled "Patrol Boat," which patent is assigned to the assignee hereof. Where any details of the watercraft 151 are not described, reference may be had to that patent for the construction of the watercraft 151.

The watercraft 151 has a catamaran-type of hull and provides a forward deck area 155 and a rear deck area 156. The rear deck area 156 is disposed between the hull portions 157 which provide the catamaran-like configuration and opens through the transom of the watercraft and is disposed substantially at the water level so as to facilitate bringing an injured person into the rear deck area 156. The front deck area 155 is also adapted to accommodate persons for rescue purposes.

Between the deck areas 155 and 156 there is provided a rider's compartment 158 which has a pair of seats 159 beneath which batteries 161 are provided. One of the seats 159 is the operator's seat and a steering wheel 162 is positioned forwardly thereof for steering the watercraft 151. Further controls may also be carried in proximity to the steering wheel 162, for example on a dash panel 163. On either side of the rear deck 156 and to the rear of the rider's compartment 158, there are provided a pair of engine compartments 164, each formed in a respective one of the hull portions 157. Internal combustion engines 165 are positioned in these engine compartments 164 forwardly of bulkheads 166.

Various auxiliaries for the engines 165 in addition to the batteries 161 may be provided in the respective hull portions 157. For example, fuel tanks 167 may be provided in the forward portion of the hull portions 157 to the rear of and adjacent the front deck 155. The deck 154 may be provided with openings through which the fill necks for the fuel tanks 167 may be extended for filling purposes.

To the rear of the bulkheads 166, the hull portions 157 are each provided with recessed tunnels 168 in which jet propulsion units of the type described in conjunction with the embodiments of FIGS. 1–7 are positioned. Since these jet propulsion units are the same as those previously described, including their clean-out portions, the reference numerals used to identify the parts of them are the same as those employed in conjunction with the description of the embodiments of FIGS. 1–7. Therefore, this construction will not be described again.

Figure 12:
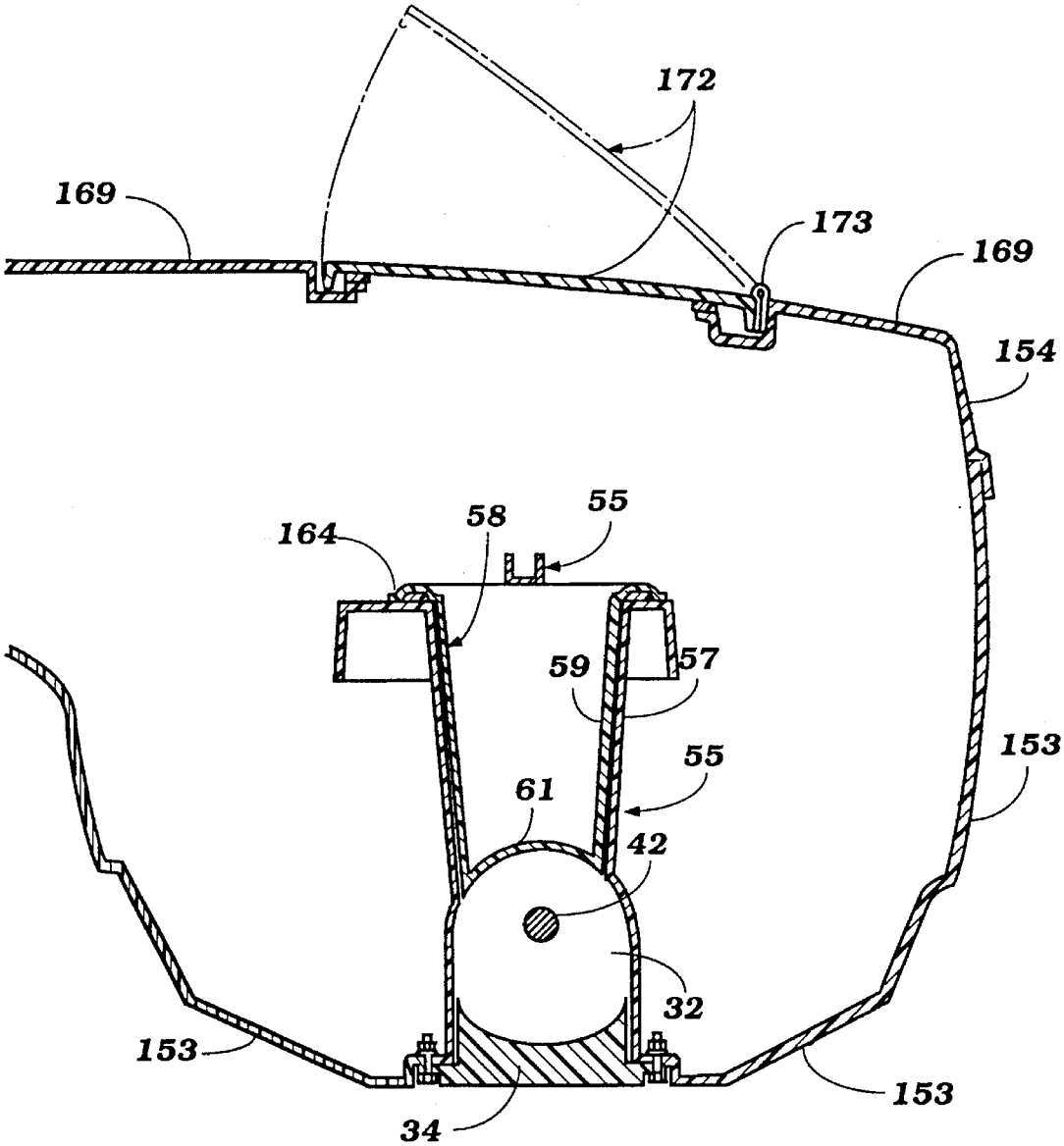
FIG. 12 is a cross-sectional view taken along the line 12—12 of FIG. 11.
Figure 13:
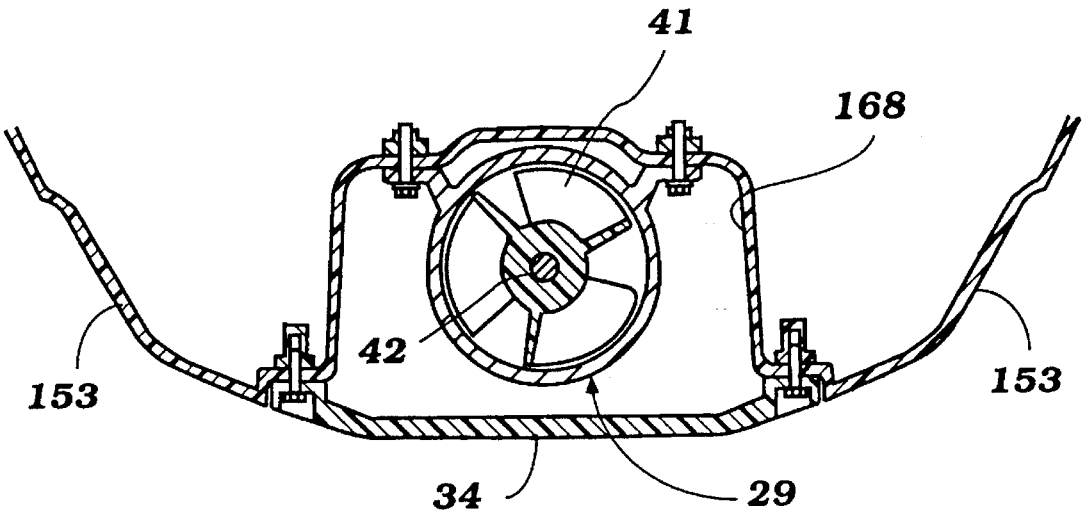
FIG. 13 is a cross-sectional view taking along the line 13—13 of FIG. 11.

It should be noted that the clean-out portions 55 of the individual jet propulsion units 29 are positioned, in this embodiment, below an upper wall 169 of the hull on opposite sides of the rear deck 156. This upper wall is formed with an access opening 171 immediately above the clean-out portions 55 on which a removable hatch cover 172 is positioned. The hatch covers 172 may be either pivoted about a transversely extending pivot access so as to swing about this axis between a closed position as shown in solid lines in FIGS. 8 and 11 and an open position as shown in phantom lines in FIG. 8. Alternatively, a strap hinge 173 may be provided that has a longitudinally extending axis so that the hatch covers 172 may be pivoted between a closed position and an open position about this axis as shown in FIG. 12.

Forwardly of the hatch covers 172 there are provided louvered hatch covers 173 over the engine compartments 164 for permitting combustion air to enter for the engines 165 and also for ventilating purposes.

In this embodiment, the clean-out portions 55 have been provided below the hatch covers 172. Alternatively, they may extend all the way up to the deck portion 169 and the removable clean-out cover 58 may be supported flush with the deck 169.

Figure 14:
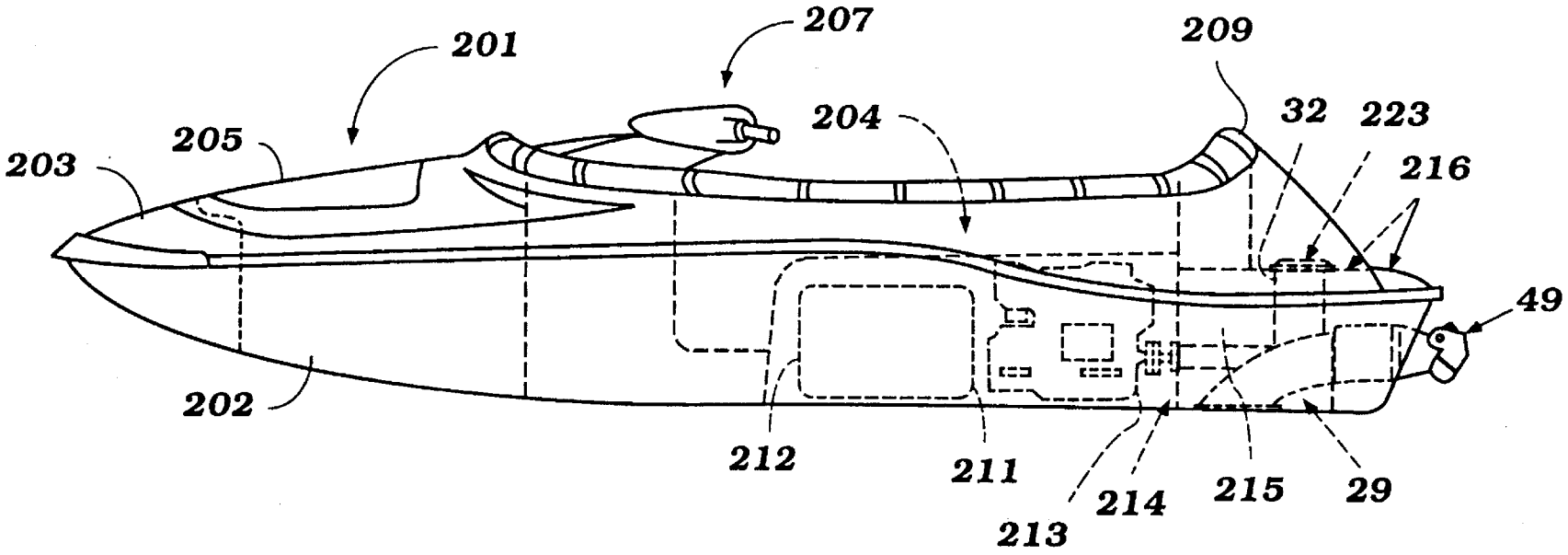
FIG. 14 is a side elevational view, in part similar to FIGS. 1 and 8, and shows yet a further embodiment of the invention.
Figure 15:
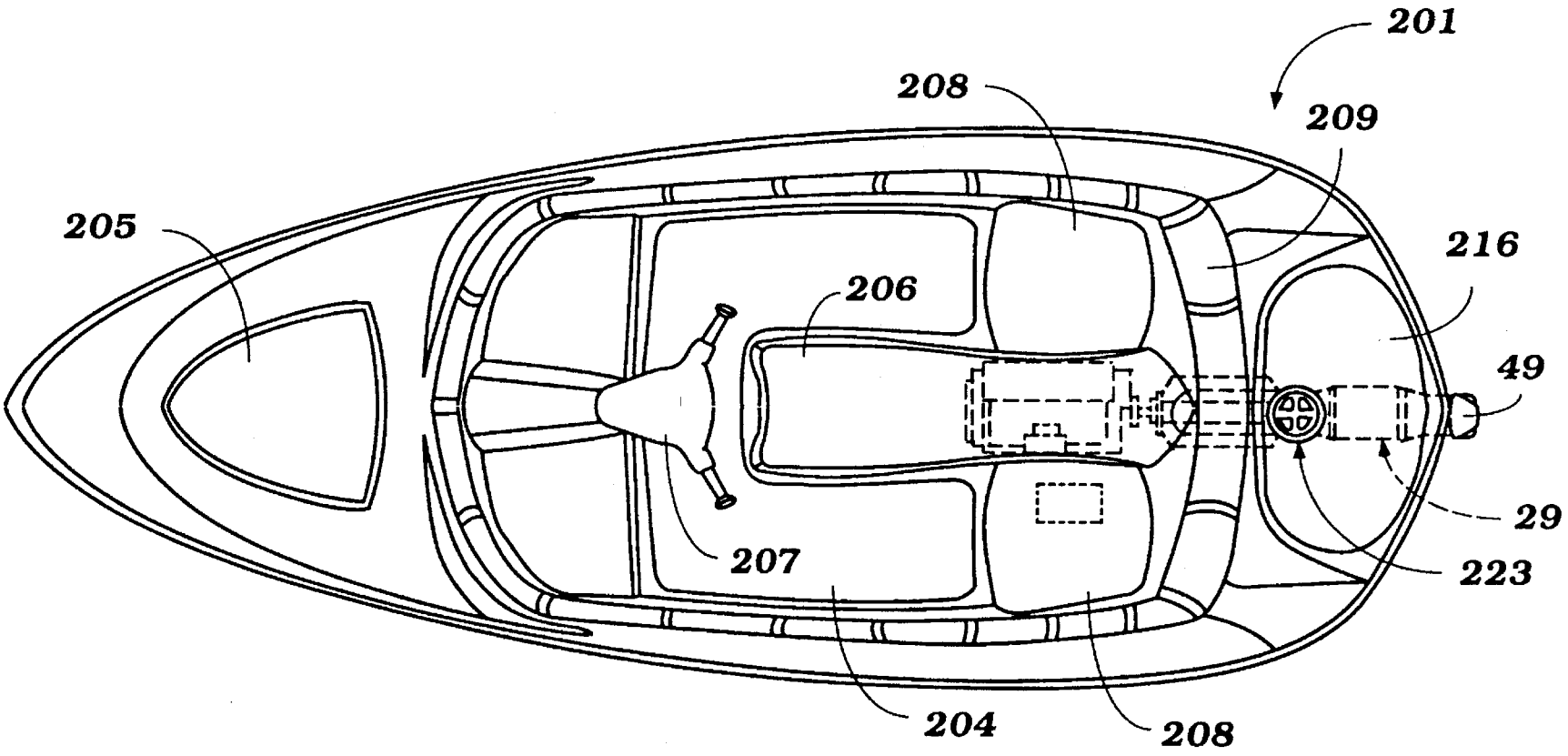
FIG. 15 is a top plan view of the watercraft shown in FIG. 14.
Figure 16:
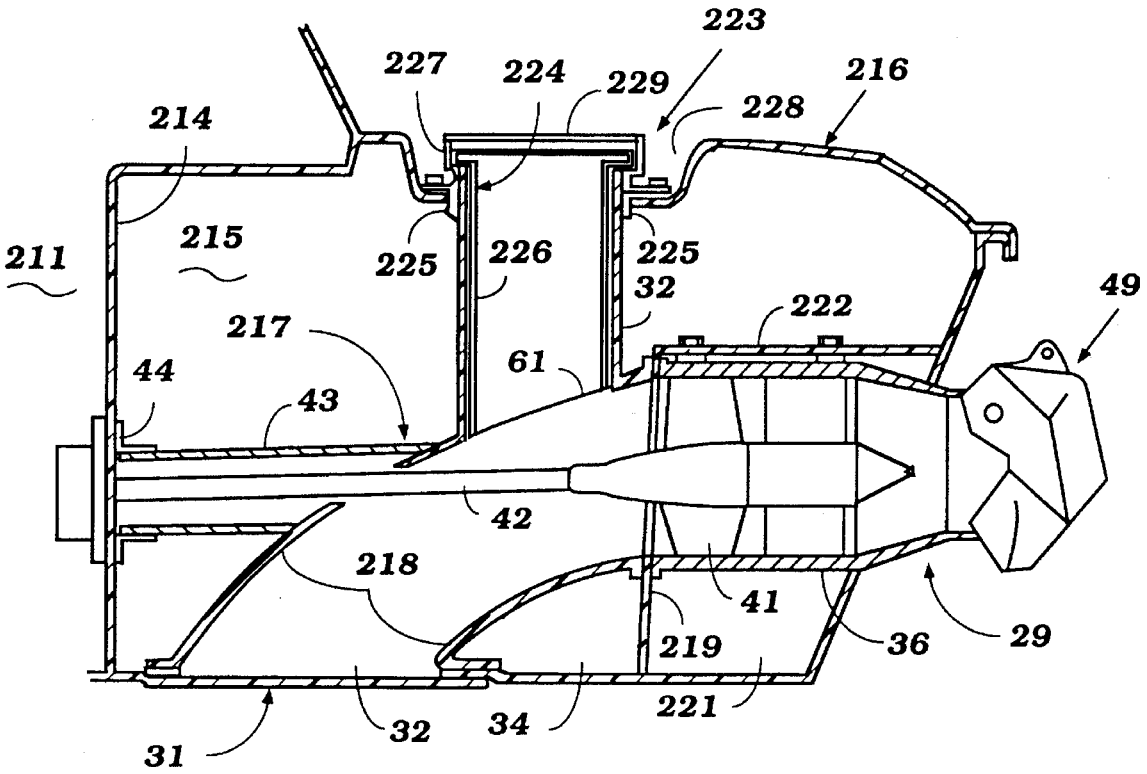
FIG. 16 is an enlarged cross-sectional view taken along a longitudinal plane through the jet propulsion unit of this embodiment and showing the clean-out arrangement.

FIGS. 14–16 show how the invention may be employed with still a further configuration of watercraft, the watercraft being identified generally by the reference numeral 201 in these figures. This different configuration of the watercraft 201 also dictates a different configuration of the clean-out mechanism.

The watercraft 201 is comprised of a hull made up of a lower hull portion 202 and an upper deck portion 203. These hull portions 202 and 203 may be formed from any suitable material, as with those previously described, such as a molded, fiberglass-reinforced resin or the like. A passenger's area 204 is provided to the rear of the front part of the deck 203. This front part may be formed with a storage compartment that is closed by a hatch cover 205.

The seating arrangement in this watercraft provides a longitudinally extending straddle-type seat 206 which may be configured generally like the seat 25 of the embodiments of FIGS. 1–7. This seat 206 can accommodate a rider and at least one passenger seated behind him in straddle tandem fashion.

A control mast 207 is provided forwardly of the seat 206 and affords control for steering of the watercraft and also for other control functions such as throttle control, etc.

To the rear in the passenger's compartment 204 and on opposite sides of the rear portion of the seat 206, there are provided a pair of side seats 208 which accommodate a pair of riders seated on opposite sides of the watercraft. Hence, this seating arrangement provides stability from side to side regardless of whether there are one, two, three or four passengers carried.

The passenger's compartment is surrounded by a padding 209 that extends around the opening formed in the upper deck 203 that defines the passenger's area 204.

An engine compartment 211 is provided beneath the seat 206 and it contains a forwardly positioned fuel tank 212 and a rearwardly positioned internal combustion engine 213. The construction of the propulsion unit, like that of the other watercraft described herein, may be of any known type.

A bulkhead 214 is formed at the rear of the engine compartment 211 and forwardly of a tunnel 215 in which a jet propulsion unit, which has a construction the same as those already described, is positioned. Since the jet propulsion unit is the same as that previously described, it has been identified by the reference numeral 29 and the other components of it have been identified by the corresponding reference numerals as described in the previous figures.

The jet propulsion unit 29 is disposed beneath a rear deck 216 formed behind the passenger's compartment 204 and which is adapted to accommodate at least one rider that may either stand on the deck 216 or may board the watercraft from the body of water in which the watercraft is operating via this deck 216.

It should be noted that in the previously described embodiments, the water inlet opening 31 and water inlet duct 32 have been formed by a portion of the hull. It has also been noted, however, that this may be formed from a separate unit which forms a part of the jet propulsion unit outer housing and such an arrangement is shown in this embodiment wherein the water inlet 32 is formed by a housing portion 217 having a curved inner surface 218. This portion is connected to a rear bulkhead 219 which defines a compartment 221 that contains the impeller housing 36 and which is closed at its upper end by a cover plate 222.

The clean-out mechanism is slightly different and this is indicated generally by the reference numeral 223 but where components are the same as those previously described, they will not be described again. In this embodiment, a closure plug 224 fits into the inner wall 32 of the clean-out portion. The wall 32 extends up to the upper deck 216 and is surrounded by a sealing grommet 225. However, the clean-out member 224 also has a cylindrical inner portion 226 which is closed by the integral wall 61 so as to provide the continuous water inlet opening 32 as with the previously described embodiments, however, a sleeve 227 is fixed to a recess 228 in the rear deck 216 and receives a removable closure 229 for clean-out purposes.

As has been noted, this type of construction may also be employed with the other embodiments, for example the embodiment of FIGS. 8–14, wherein the clean-out portion is disposed beneath a part of the upper deck.

It should be readily apparent from the foregoing description that the described embodiments of the invention provide very effective ways in which a jet propulsion unit may be positioned permanently within the hull of a watercraft and yet its water inlet portion can be easily accessed for clean-out without having to do this from beneath the watercraft or without having the remove the watercraft from the body of water in which it is operating. Of course, the foregoing description is that of preferred embodiments of the invention and various changes and modifications may be made without departing from the spirit and scope of the invention, as defined by the appended claims.

What is claimed is:

1. A clean-out arrangement for the jet propulsion unit of a watercraft, said watercraft having a hull defining a recess in an under surface thereof, a jet propulsion unit mounted at least in part in said recess, said jet propulsion unit comprising a water inlet portion defining a downwardly facing inlet opening through which water may be drawn from a body of water in which said hull is operating, an impeller portion journaling an impeller for receiving and drawing water through said water inlet portion, and a discharge nozzle portion through which water pumped by said impeller is discharged for propelling said hull through a body of water, at least a part of one of said portions being removable from above for cleaning foreign objects from the water path therethrough, said removable part having a surface which forms a portion of a continuous uninterrupted portion of the water path when not removed.

2. A clean-out arrangement for the jet propulsion unit of a watercraft as set forth in claim 1, wherein the removable part can be removed when the jet propulsion unit is mounted within the hull.

3. A clean-out arrangement for the jet propulsion unit of a watercraft as set forth in claim 2, wherein the removable part comprises a part of the water inlet portion.

4. A clean-out arrangement for the jet propulsion unit of a watercraft as set forth in claim 3, wherein the hull is formed with an access opening through which the removable part may be removed.

5. A clean-out arrangement for the jet propulsion unit of a watercraft as set forth in claim 4, wherein the hull access opening is positioned beneath a seat in the rider's area.

6. A clean-out arrangement for the jet propulsion unit of a watercraft as set forth in claim 4, wherein the access opening is formed in an upper part of the hull.

7. A clean-out arrangement for the jet propulsion unit of a watercraft as set forth in claim 6, wherein the upper part of the hull comprises an upper deck surface of the hull.

8. A clean-out arrangement for the jet propulsion unit of a watercraft as set forth in claim 7, wherein the removable part is positioned in a compartment defined beneath the upper deck surface.

9. A clean-out arrangement for the jet propulsion unit of a watercraft as set forth in claim 8, wherein the upper deck surface is provided with a pivoted closure through which the removable part may be accessed.

10. A clean-out arrangement for the jet propulsion unit of a watercraft, said watercraft having a hull defining a passenger area, a deck at the rear of said passenger area and a recess in an under surface thereof, a jet propulsion unit mounted at least in part in said recess, said jet propulsion unit comprising a water inlet portion defining a downwardly facing inlet opening through which water may be drawn from a body of water in which said hull is operating, an impeller portion journaling an impeller for receiving and drawing water through said water inlet portion, and a discharge nozzle portion through which water pumped by said impeller is discharged for propelling said hull through a body of water, at least a part of one of said portions being removable from above for cleaning foreign objects from the water path therethrough, said removable part lying under said deck and an access opening formed flush with an upper surface of said deck through which said removable part may be accessed.

11. A clean-out arrangement for the jet propulsion unit of a watercraft said watercraft having a hull defining a recess in an under surface thereof, a jet propulsion unit mounted at least in part in said recess, said jet propulsion unit comprising a water inlet portion defining a downwardly facing inlet opening through which water may be drawn from a body of water in which said hull is operating, an impeller portion journaling an impeller for receiving and drawing water through said water inlet portion, and a discharge nozzle portion through which water pumped by said impeller is discharged for propelling said hull through a body of water, at least a part of one of said portions having a panel removable from above for cleaning foreign objects from the water path therethrough, prime mover for driving said impeller and means for disabling said prime mover when said removable panel is removed.

12. A clean-out arrangement for the jet propulsion unit of a watercraft as set forth in claim 11, wherein the disabling means comprises a switch responsive to the position of the removable panel.

13. A clean-out arrangement for the jet propulsion unit of a watercraft, said watercraft having a hull defining a recess in an under surface thereof, a jet propulsion unit mounted at least in part in said recess, said jet propulsion unit comprising a water inlet portion defining a downwardly facing inlet opening through which water may be drawn from a body of water in which said hull is operating, an impeller shaft extending through said water inlet portion and driving an impeller for receiving and drawing water through said water inlet portion, and a discharge nozzle portion through which water pumped by said impeller is discharged for propelling said hull through a body of water, at least a part of said water inlet portion being removable from above for cleaning foreign objects from the water path therethrough, said removable part, when removed, leaving an open access opening that is offset to one side of the impeller shaft.

14. A clean-out arrangement for the jet propulsion unit of a watercraft as set forth in claim 13, wherein the removable part can be removed when the jet propulsion unit is mounted within the hull.

15. A clean-out arrangement for the jet propulsion unit of a watercraft as set forth in claim 14, wherein the hull is formed with an access opening through which the removable part may be removed.

16. A clean-out arrangement for the jet propulsion unit of a watercraft as set forth in claim 15, wherein the hull access opening is positioned beneath a seat in the rider's area.

17. A clean-out arrangement for the jet propulsion unit of a watercraft as set forth in claim 15, wherein the access opening is formed in an upper part of the hull.

18. A clean-out arrangement for the jet propulsion unit of a watercraft as set forth in claim 17, wherein the upper part of the hull comprises an upper deck surface of the hull.

19. A clean-out arrangement for the jet propulsion unit of a watercraft as set forth in claim 18, wherein the removable part is positioned in a compartment defined beneath the upper hull surface.

20. A clean-out arrangement for the jet propulsion unit of a watercraft as set forth in claim 19, wherein the upper hull surface is provided with a pivoted closure through which the removable part may be accessed.

21. A clean-out arrangement for the jet propulsion unit of a watercraft as set forth in claim 17, wherein the access opening is formed flush with the upper deck surface.

22. A clean-out arrangement for the jet propulsion unit of a watercraft as set forth in claim 21, wherein the upper deck surface comprises a rear deck formed to the rear of a passenger's area formed in the hull.

23. A clean-out arrangement for the jet propulsion unit of a watercraft as set forth in claim 14, wherein the removable part comprises a removable panel formed in the jet propulsion unit portion.

24. A clean-out arrangement for the jet propulsion unit of a watercraft as set forth in claim 23, further including a prime mover for driving the impeller and means for disabling the prime mover when the removable panel is removed.

25. A clean-out arrangement for the jet propulsion unit of a watercraft as set forth in claim 24, wherein the disabling means comprises a switch responsive to the position of the removable portion.

* * * * *